United States Patent [19]

Clarke et al.

[11] 4,083,205

[45] Apr. 11, 1978

[54] TEXTILE PRINTING APPARATUS

[75] Inventors: William Clarke; Brian Glover; Guillaume Ward Jamin, all of Manchester, England

[73] Assignee: Imperial Chemical Industries Limited, England

[21] Appl. No.: 707,248

[22] Filed: Jul. 21, 1976

Related U.S. Application Data

[63] Continuation of Ser. No. 174,906, Oct. 14, 1971, abandoned.

[30] Foreign Application Priority Data

Nov. 5, 1970 United Kingdom ..... 52710/70

[51] Int. Cl.[2] ..... D06B 1/10; B30B 15/34; D06F 71/36

[52] U.S. Cl. ..... 68/5 C; 8/2.5 A; 68/200; 100/93 P; 100/233; 118/50.1; 118/59; 156/382; 156/583

[58] Field of Search ..... 68/5 A, 5 C, 5 E, 5 R, 68/6, 13 R, 200, 240; 100/90, 93 P, 233; 118/50, 50.1, 59; 8/2.5 R, 2.5 A; 156/382, 285, 286, 583, 277, 230

[56] References Cited

U.S. PATENT DOCUMENTS

| | | | |
|---|---|---|---|
| 2,225,870 | 12/1940 | Kämpfer | 100/90 |
| 2,990,872 | 7/1961 | Gaby | 100/93 P |
| 3,047,052 | 7/1962 | Fridrich | 156/583 X |
| 3,202,561 | 8/1965 | Swanson et al. | 156/216 |
| 3,243,629 | 3/1966 | Levetan | 156/285 X |

*Primary Examiner*—William A. Powell
*Assistant Examiner*—Thomas Bokan
*Attorney, Agent, or Firm*—Cushman, Darby & Cushman

[57] ABSTRACT

Apparatus suitable for carrying out the coloring of synthetic textile materials by a vacuum transfer printing process, the apparatus comprising means for bringing the textile material into contact with the printed surface of a carrier material which has been printed with a water-insoluble dyestuff, means for subjecting the textile material and printed carrier material while in such contact to a pressure of not more than 100 mm. of mercury, and means for heating the textile material and the printed carrier material while subjected to the said pressure to a temperature above 100° C.

11 Claims, 3 Drawing Figures

TEXTILE PRINTING APPARATUS

This is a continuation of application Ser. No. 174,906 filed Oct. 14, 1971 now abandoned.

This invention relates to apparatus suitable for carrying out the colouring of textile materials by the transfer printing technique, and more particularly by such a technique in which the textile material and the transfer paper bearing the dyestuff are subjected to vacuum whilst they are heated in contact with each other.

Synthetic textile materials, or unions containing synthetic textile materials can be coloured by a process wherein a print paste or printing ink containing a water-insoluble dyestuff is printed on to a cellulose material, the printed material is dried, and is then placed in contact with the synthetic textile material and the whole subjected to a dry heat treatment at a pressure less than atmospheric pressure, preferably at a pressure of between 0.1 and 100 mm. of mercury. Such a process may be described as a vacuum transfer printing process.

According to the present invention there is provided apparatus suitable for carrying out the colouring of synthetic textile materials by a vacuum transfer printing process, the apparatus comprising means for bringing the textile material into contact with the printed surface of a carrier material which has been printed with a water-insoluble dyestuff, means for subjecting the textile material and printed carrier material whilst in such contact to a pressure of not more than 100 mm. of mercury, and means for heating the textile material and the printed carrier material whilst subjected to the pressure to a temperature above 100° C.

According to one form of the invention, the apparatus is suitable for intermittent operation and comprises upper and lower rigid platens mounted for relative movement towards or away from each other, means for heating at least one of the platens to a temperature above 100° C, sealing means for enclosing an air-tight region between opposed portions of the surfaces of the platens when the platens are closed, and means for evacuating the said region to a pressure of not more than 100 mm. of mercury.

In operating the apparatus thus defined, the textile material which is to be coloured is placed together with the carrier material which has been printed with the water-insoluble dyestuff, the textile material being in loose contact with the printed surface of the carrier material, between the two platens in such a position that when the platens are closed the textile material and the printed carrier material lie within the region enclosed by the sealing means. The carrier material for the water-insoluble dyestuff will normally consist of a cellulosic sheet material, in particular paper, but may alternatively consist of a metal foil or a metal foil supported upon a cellulosic material. The act of closing the platens causes the printed surface of the carrier material to be pressed into intimate contact with the textile material. The textile material and the carrier material are then subjected to a pressure of not more than 100 mm. of mercury by evacuating the sealed region in which they are enclosed, and one or both platens is raised to a temperature of above 100° C so that the heat therefrom is transferred by contact to the textile material or the carrier material or both. During the process of heating under vacuum, the water-insoluble dyestuff on the surface of the carrier material is transferred by sublimation from the carrier material to the textile material. The vacuum is then released, the platens are separated and the carrier material is stripped from the textile material, which now carries a coloured pattern which is a mirror image of the pattern originally printed on the carrier material.

Preferably the textile material and the carrier material are placed in the apparatus so that the unprinted surface of the carrier material is in contact with a heated platen. It is also preferred that vacuum is applied to the combination of textile material and carrier material from the textile material side, on account of the generally more open texture of the latter which facilitates the extraction of air.

The sealing means whereby the region between the platens containing the textile material and the carrier material is maintained air-tight when the platens are closed may conveniently consist of an endless band or loop of elastic material which is capable of being compressed between the two platens. Such a band or loop may be carried upon an individual support whereby it may be brought into position between the platens when the latter are about to be closed, but a simple and satisfactory form of sealing means consists of an O-ring composed of silicone rubber or other elastic material resistant to heat which is accommodated in a suitably shaped recess in the surface of the lower platen.

The means for evacuating the enclosed region between the platens may consist of any suitable form of vacuum pump, but in order to achieve a rapid exhaustion of air from the textile material and carrier material and reduction of pressure to the specified level it is preferred to provide a vacuum reservoir between the pump and the evacuable region.

The means for heating one of the platens may be, for example, an electrical heating element, or alternatively a system for circulating a heat transfer fluid such as air, steam or oil.

In a preferred form of the apparatus, the upper platen moves in relation to the lower platen which is fixed, the upper platen being provided with means whereby it may be heated and the lower platen being provided with a suitable connection to the evacuating means. In order that the region in which the textile material and the carrier material are enclosed when the platens are brought together may be smoothly and rapidly evacuated, an especially preferred feature of this form of the apparatus consists of a porous plate of sintered stainless steel which is inlaid into the lower platen and forms the surface upon which the textile material or the carrier material, preferably the former, is supported during the vacuum/heat treatment, the lower side of the porous plate being in communication with the evacuating means.

The upper and lower platens may if desired be arranged to be opened and closed manually, but it is preferred to provide a mechanical means for effecting opening and closing, such as a piston and cylinder actuated by compressed air or a pressurised fluid.

By way of illustration, an apparatus which is a preferred embodiment of the invention will now be described, with reference to the accompanying drawings in which.

Figure 1:
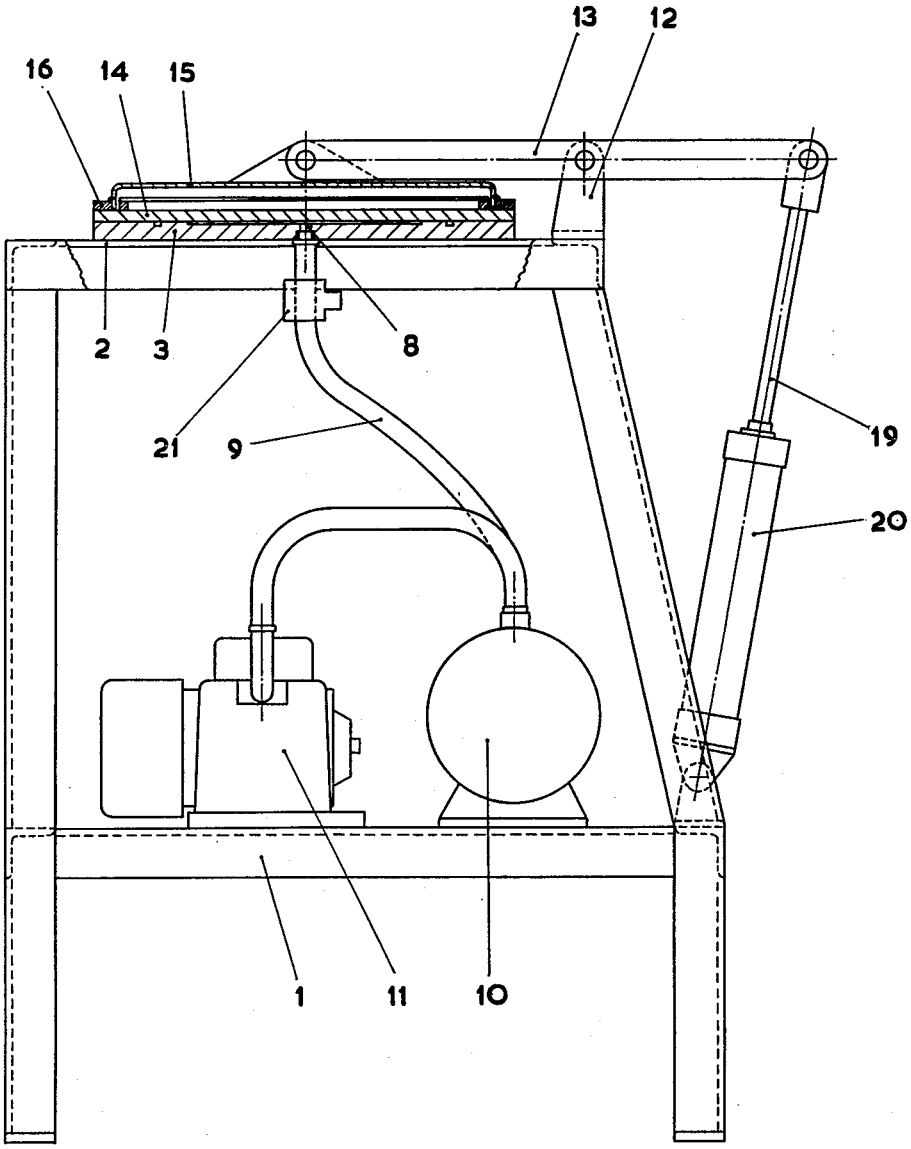
FIG. 1 is an elevation of the apparatus with the upper and lower platens shown in section.

The apparatus consists of a frame 1 the upper part of which forms a table 2 upon which there is supported a rigid square metal platen 3. The platen is provided with a square central recess 4 having a number of short upstanding projections 5 on its bottom surface. The recess receives a porous plate 6 of sintered stainless steel, which rests upon the projections 5 and the upper surface of which is coplanar with the upper surface of the platen 3. The platen 3 also contains in its upper surface a narrow recess which accommodates a silicone rubber O-ring 7. A conduit 8 communicates, via a pipe 9, between the recess 4 and the vacuum reservoir 10, which in turn is connected with a vacuum pump 11. The table 2 carries at one side trunnions 12 upon which are pivoted arms 13. One end of each arm is linked to an upper platen assembly, consisting of a rigid, square metal upper platen proper 14, of similar dimensions to the lower platen 3, a domed cover member 15 having a rim 16 which in turn is secured to the platen 14, and a heating member consisting of a woven heating net 17 carried upon insulation material 18 also secured to the platen 14. The ends of the arms 13 remote from the upper platen assembly are linked to the piston rod 19 of an air cylinder and piston 20; the lower end of the cylinder is pivotally attached to the frame 1. The apparatus also incorporates a quick-acting valve 21 shown schematically in FIG. 1 whereby the recess 4 and the porous plate 6 may be connected to the vacuum supply pipe 9 or released to atmosphere, as desired; a source of compressed air together with a suitable valve (not shown) for actuation of the air cylinder 20; and a source of electrical power (not shown) for the heater 17, incorporating a temperature controller whereby the platen 14 may be maintained at a chosen temperature above 100° C.

The apparatus is operated in the following manner. The upper platen 14 is first raised to its working temperature. Then, with the air cylinder 20 actuated so as to withdraw the piston rod 19 and to raise the upper platen to the open position, a piece of the textile material to be printed, of a size not greater than that of the porous plate 6, is placed upon the plate 6, and overlaid by a suitably sized carrier material, with the printed surface thereof in contact with the textile material. The air cylinder 20 is then operated to drive the piston rod 19 upwardly, closing the heated upper platen 14 on to the lower platen 3, thus pressing the textile material and the carrier material closely into contact and at the same time forming an air-tight seal with the silicone rubber O-ring 7. Simultaneously with this operation the valve 21 is opened to connect the porous plate 6 and the space between the platens within the O-ring to the vacuum reservoir 10, causing a rapid removal of air from the textile material and the carrier material and a reduction of the pressure to which the latter are subjected to 100 mm. of mercury of less. The heated upper platen 14 raises the temperature of the textile material and carrier material to above 100° C. After a sufficient period of time has elapsed for effective transfer of the dyestuff from the printed surface of the carrier material to the textile material (normally only a few seconds are required for this purpose) the valve 21 is operated so as to close off the vacuum source and release the vacuum in the space between the platens to atmosphere. The air cylinder 20 is then activated to open the upper platen, the heater 17 is switched off, and the textile material separated from the carrier material. The now coloured textile material is finally subjected to any after-treatment process which may be necessary, having regard to the nature of the material and the dyestuff employed. Preferably, however, the dyestuff and the textile material are so chosen that after treatment is not required.

It has been found that with certain types or forms of textile materials, for example bulked polyester yarns in knitted form, the transfer operation can give rise to undesirable changes in the properties of the yarns, especially in regard to handle. These undesirable changes are believed to be due to excessive mechanical loading of the top platen on the textile material, the effective load of the top platen on the textile material increasing to an undesirable extent as the vacuum around the textile material is increased. This disadvantage can be overcome by attaching a compensating device to the top platen which maintains the original load on the textile material due to the application of the top platen throughout the duration of the period during which vacuum is applied to the textile material.

Figure 2:
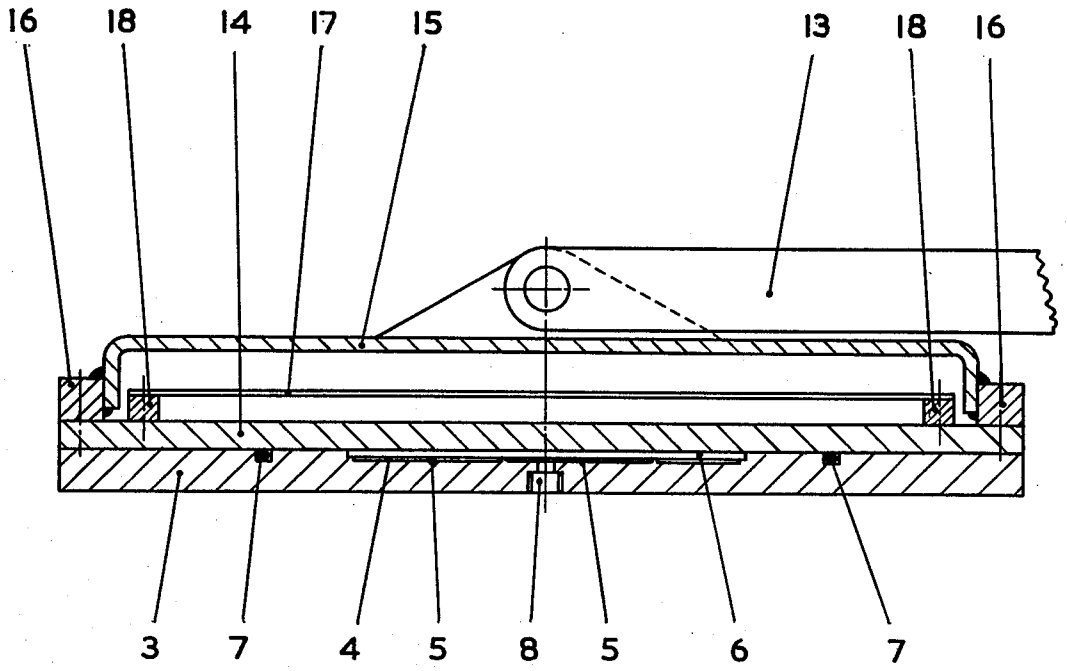
FIG. 2 is an enlarged sectional view showing the upper and lower platens in greater detail.
Figure 3:
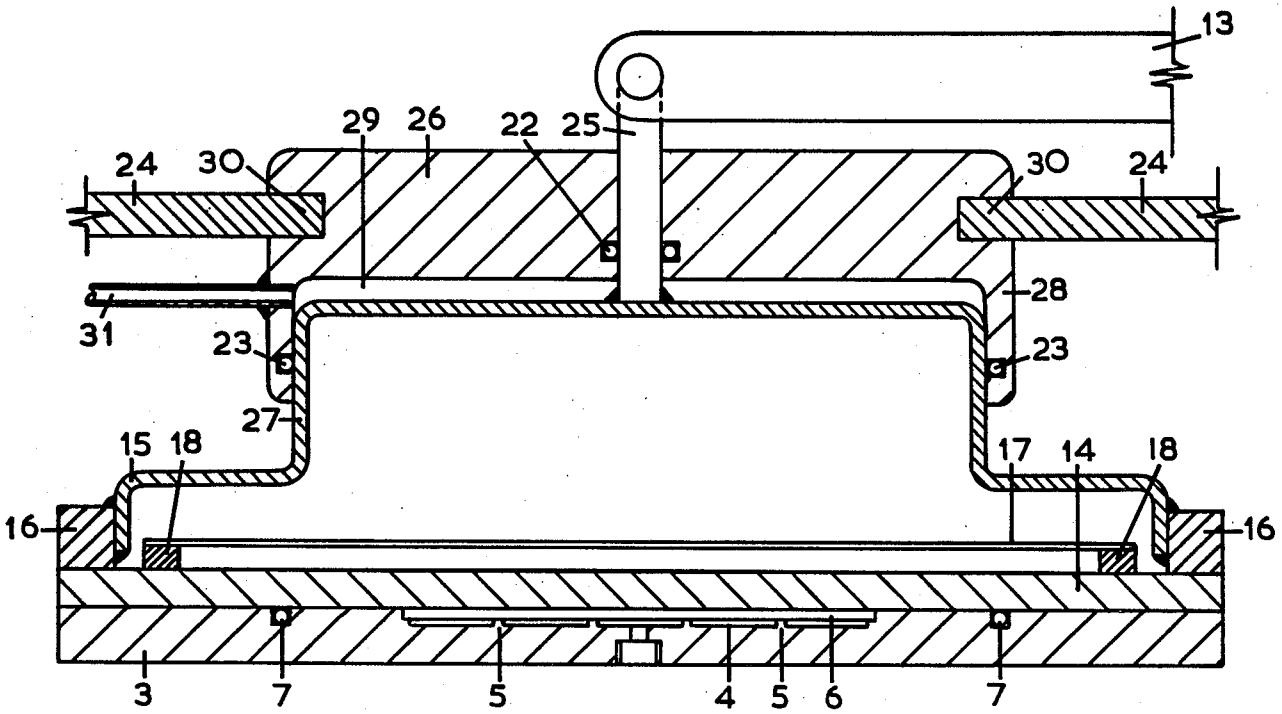

By way of illustration, FIG. 3 is a sectional view which illustrates such a compensating device attached to the top platen. In FIG. 3, the reference numbers 3 to 18 inclusive have the meanings which have been previously ascribed to them in relation to FIGS. 1 and 2.

In this apparatus the pivoted arm 13 (which is attached at one end to the piston rod 19) is attached via a cylindrical rod 25 to the domed cover member 15 the upper sides 27 of which form a cylinder which has a cross-sectional area equivalent to the area enclosed by the silicone rubber O-ring 7. The cylindrical rod 25 passes through the centre of a dome shaped cover 26 of circular cross section, the lower edges 28 of which are in close proximity to the upper sides 27. A sealing ring or gland 22 maintains a vacuum tight joint between the rod 25 and the cover 26; whilst a sealing ring 23 maintains a vacuum tight joint between the edges 28 and the sides 27. A pipe 31 passing through the dome shaped cover 26 connects the recess 29 via the valve 21 to the vacuum reservoir 10 (not shown). The domed shaped cover 26 is maintained in position by means of two or more locking arms 24 which fit into sockets 30 in the said cover.

This apparatus is operated in the same manner as the apparatus previously described, but as the upper platen 14 is closed onto the lower platen 3, the arms 24 are inserted into the sockets 30 thus locking the dome shaped cover 26 in position. Operation of the valve 21 simultaneously causes a rapid removal of air from the textile material held between the two platens and from the recess 29 so that the air pressures around the textile material and in the recess 29 are both at the same level at less than 100 mms. of mercury. After completion of the process the locking arms 24 are withdrawn before the upper platen is raised by activation of the air cylinder 20 (not shown).

It will be understood that certain details of the apparatus which has been described may be varied without departing from the essential characteristics of the present invention. Thus, instead of the upper platen being provided with the heating means and the lower platen being adapted for connection to the source of vacuum, the lower platen may be provided with the heating means and either the upper platen or the lower platen provided with the vacuum connection. If desired, both the upper and the lower platens may be heated, which makes it possible to process two pieces of textile material simultaneously, each with its own carrier material, or alternatively one piece of textile material can be printed on both sides, each side of the textile material being placed in contact with the printed surface of a carrier material. In this case it may be preferable, rather than to provide a vacuum connection to each platen and a sealing means located between the platens, to arrange for the upper and lower platens to be surrounded by halves of a surrounding envelope which are brought together when the platens are closed; the meeting edges of the half-envelopes are provided with sealing means and one half is adapted for connection to the vacuum source so that the envelope as a whole may be evacuated together with the platens and the textile materials and carrier materials located between them.

The printed carrier material used in the above apparatus can be obtained by applying a print paste or printing ink containing a water-insoluble dyestuff to one surface of the carrier material by any of the known techniques for applying print pastes or printing inks, for example by gravure, flexographic or flat or rotary screen printing methods. Preferably the printed carrier material is dried before being placed in contact with the textile material.

The said print pastes or printing inks comprise, as the main ingredients one or more water-insoluble dyestuffs, a binder and a liquid medium, such as water or an organic liquid for example toluene, ethanol or isopropanol or mixtures of organic liquids, which are conventionally used in print pastes or printing inks.

The carrier materials thus generally carry on one surface a layer of a water-insoluble dyestuff and a binder. In order that the binder is not also transferred to the textile material or becomes permanently attached to the textile material it is necessary that the binder is stable at temperatures of up to 250° C. Binders which can be used in the said print pastes or printing inks are any of the binders which are conventionally used in such compositions, for example cellulose ethers such as ethylcellulose and $\beta$-hydroxyethylcellulose.

The water-insoluble dyestuffs can be any of the known classes of water-insoluble or disperse dyestuffs which are commercially available for colouring synthetic textile materials or which have been described in, for example, the second edition of the Colour Index which was published in 1965. A preferred class for dyestuffs for use in the said print pastes or printing inks are those falling within the categories of Class C and Class D Disperse Dyestuffs (this classification being based on a combination of dyeing properties and fastness to dry heat) and is described in the Journal of the Socety of Dyers and Colourists 1969 at pages 606 to 613 and in Technical Information Note D.1055 titled "Synthetic Fibre Dyeing — Classification of disperse dyes according to dyeing and heat fastness properties" which was published by Imperial Chemical Industries Limited in 1968. These Class C and Class D dyestuffs have high heat fastness properties when applied to synthetic textile material and hence have low sublimation rates so that their use has not previously been possible in transfer printing processes. However using the apparatus of the invention such dyestuffs can be readily transferred from the surface of the carrier material to the textile material, and after the said application, the so-coloured textile materials exhibit the same standard of fastness as the colourations obtained when the said dyestuffs are applied to the textile materials by conventional aqueous dyeing procedures.

The textile materials which can be used in the apparatus are preferably synthetic textile materials such as cellulose triacetate, synthetic linear polyamide for example nylon 6 and nylon 6:6, and aromatic polyester, for example polyethylene terephthalate textile materials. Alternatively there can be used other textile materials, such as wool or cotton, or leather which has been precoated with a substance, such as a polyamide or a polyacrylic resin, which has an affinity for the disperse dyestuffs.

What we claim is:

1. Apparatus suitable for carrying out the coloration of synthetic textile materials with a printed carrier material by a vacuum transfer printing process in an intermittent operation consisting essentially of upper and lower rigid platens mounted for relative movement towards or away from each other so that when said platens are closed, said platens cause the printed surface of said carrier material to be pressed into intimate contact with said textile material, means for heating at least one of the platens at least in the area where the carrier material and textile material are pressed together to a temperature above 100° C. so that the heat therefrom is transferred by contact to one or both of said textile material and said carrier material, sealing means for enclosing an air-tight region extending between opposed portions of the surfaces of the platens when the platens are closed so that said region is air-tight, whereby said synthetic textile material and said printed carrier material are containable within said air-tight region enclosed by said sealing means and means for evacuating the said region to a pressure of not more than 100 mm. of mercury.

2. The apparatus of claim 1 wherein the upper platen is mounted for relative movement towards or away from the lower platen which is fixed.

3. The apparatus of claim 1 wherein the upper platen is provided with means for heating it to a temperature of at least 100° C.

4. The apparatus of claim 1 wherein the lower platen is provided with a suitable connection to the evacuating means.

5. The apparatus of claim 1 wherein a porous plate of sintered stainless steel is inlaid into the lower platen and the lower side of the porous plate is connected to the evacuating means.

6. Apparatus suitable for carrying out the coloration of synthetic textile materials with a printed carrier material by a vacuum transfer printing process in an intermittent operation consisting essentially of upper and lower rigid platens mounted for relative movement towards or away from each other so that when said platens are closed, said platens cause the printed surface of said carrier material to be pressed into intimate contact with said textile material, means for heating at least one of the platens to a temperature above 100° C. so that the heat therefrom is transferred by contact to one or both of said textile material and said carrier material, sealing means for enclosing an air-tight region extending between opposed portions of the surfaces of the platens when the platens are closed so that said region is air-tight whereby said synthetic textile material and said printed carrier material are containable within said air-tight region enclosed by said sealing means, means for evacuating the said region to a pressure of not more than 100 mm. of mercury and a compensating device attached to said upper platen to maintain the original load on said textile material due to the application of the upper platen throughout the duration of the period during which vacuum is applied to the textile material.

7. The apparatus of claim 6 wherein the upper platen is mounted for relative movement towards or away from the lower platen which is fixed.

8. The apparatus of claim 6 wherein the upper platen is provided with means for heating it to a temperature of at least 100° C.

9. The apparatus of claim 6 wherein the lower platen is provided with a suitable connection to said evacuating means.

10. The apparatus of claim 6 wherein a porous plate of sintered stainless steel is inlaid into the lower platen and the lower side of the porous plate is connected to the evacuating means.

11. Apparatus suitable for carrying out the coloration of synthetic textile materials with a printed carrier material by a vacuum transfer printing process in an intermittent operation consisting essentially of an upper platen which is mounted for relative movement towards and away from a lower platen so that when said platens are closed, said platens cause the printed surface of said carrier material to be pressed into intimate contact with said textile material, means for heating the upper platen to a temperature of at least 100° C. so that the heat therefrom is transferred by contact to one or both of said textile material and said carrier material, sealing means for enclosing an air-tight region extending between opposed portions when the platens are closed so that said region is air-tight whereby said synthetic textile material and said printed carrier material are containable within said air-tight region enclosed by said sealing means, evacuating means in communication with the lower platen for evacuating said region to a pressure of not more than 100 mm. of mercury, a porous plate inlaid into the lower platen to form a surface coplanar with the upper surface of the lower platen upon which said textile material or carrier material is supported during treatment, said porous plate being in communication at its lower surface with said evacuating means and a compensating device attached to said upper platen to maintain the original load on said textile material due to the application of the upper platen throughout the duration of the period during which vacuum is applied to the textile material.

* * * * *